US010858961B2

(12) United States Patent
Neunteufl et al.

(10) Patent No.: US 10,858,961 B2
(45) Date of Patent: Dec. 8, 2020

(54) METHOD FOR CONTROLLING A WASTE HEAT UTILIZATION SYSTEM FOR AN INTERNAL COMBUSTION ENGINE

(71) Applicants: AVL LIST GMBH, Graz (AT); IVECO S.P.A., Turin (IT); FPT INDUSTRIAL S.P.A., Turin (IT); MAHLE AMOVIS GMBH, Berlin (DE)

(72) Inventors: Klemens Neunteufl, Graz (AT); Oswald Lackner, Fehring (AT); Gerald Gradwohl, Graz (AT); Michael Bucher, Berlin (DE); Fabio Cococcetta, Zürich (CH); Ivan Calaon, Turin (IT); Michael Glensvig, Graz (AT)

(73) Assignees: AVL LIST GMBH, Graz (AT); IVECO S.P.A., Turin (IT); FPT INDUSTRIAL S.P.A., Turin (IT); MAHLE AMOVIS GMBH, Berlin (DE)

( * ) Notice: Subject to any disclaimer, the term of this patent is extended or adjusted under 35 U.S.C. 154(b) by 418 days.

(21) Appl. No.: 15/743,184

(22) PCT Filed: Jul. 11, 2016

(86) PCT No.: PCT/AT2016/050246
§ 371 (c)(1),
(2) Date: Jan. 9, 2018

(87) PCT Pub. No.: WO2017/008094
PCT Pub. Date: Jan. 19, 2017

(65) Prior Publication Data

US 2020/0088069 A1 Mar. 19, 2020

(30) Foreign Application Priority Data

Jul. 10, 2015 (AT) ..... A 50608/2015

(51) Int. Cl.
*F01K 23/14* (2006.01)
*F01K 13/02* (2006.01)
(Continued)

(52) U.S. Cl.
CPC ..... *F01K 23/14* (2013.01); *F01K 13/02* (2013.01); *F01K 23/065* (2013.01); *F01K 25/08* (2013.01); *F02G 5/02* (2013.01)

(58) Field of Classification Search
CPC ..... F15K 23/065; F15K 23/10; F15K 23/14; F02G 5/02; H02K 7/1823; F01N 5/02; F05D 2220/62
(Continued)

(56) References Cited

U.S. PATENT DOCUMENTS 8,635,871 B2 1/2014 Ernst et al.
2009/0071156 A1 3/2009 Nishikawa et al.
(Continued)

*Primary Examiner* — Mark A Laurenzi
*Assistant Examiner* — Dapinder Singh
(74) *Attorney, Agent, or Firm* — Dykema Gossett PLLC

(57) ABSTRACT

The invention relates to a method for controlling a waste-heat utilization system (20) for an internal combustion engine (10) of a vehicle, wherein the waste-heat utilization system (20) has at least one expander (22), which can transmit torque to the internal combustion engine (10) and which can be bypassed by means of a bypass flow path (25), at least one evaporator (21), and at least one pump (24) for an operating medium, and wherein at least the evaporator (21) is arranged in the region of the exhaust gas system (11) of the internal combustion engine (10). The expander (22), which can be operated in several operating modes, has a driving connection to a secondary drive shaft (19) of the internal combustion engine in at least one operating mode. An operating mode of the waste-heat utilization system (20) is selected by a control device (30) on the basis of at least one input variable and the waste-heat utilization system (20) is operated in said operating mode. The input variable is
(Continued)

selected by the control device (30) from the group consisting of expander rotational speed (n), gear information (GI), coasting information (CI), and pressure ($p_1$, $p_2$) and temperature ($T_1$, $T_2$) of the operating medium upstream or downstream of the expander (22). A first operating mode (1) is associated with a warm-up phase of the expander (22) and a second operating mode (2) is associated with a normal operating phase of the expander (22). In the first operating mode, the bypass flow path (25) is opened and the expander (22) is not connected to a secondary drive shaft (19) of the internal combustion engine (10). In the second operating mode, the bypass flow path (25) is closed and the expander (22) is connected to the internal combustion engine (10). The second operating mode (2) is selected if the pressure ($p_2$) and/or the temperature ($T_2$) of the operating medium downstream of the expander (22) exceeds a defined value.

22 Claims, 2 Drawing Sheets

(51) Int. Cl.
*F01K 23/06* (2006.01)
*F01K 25/08* (2006.01)
*F02G 5/02* (2006.01)

(58) Field of Classification Search
USPC ..... 60/615
See application file for complete search history.

(56) References Cited

U.S. PATENT DOCUMENTS

| | | | | |
|---|---|---|---|---|
| 2009/0211253 | A1 | 8/2009 | Radcliff et al. | |
| 2010/0018207 | A1* | 1/2010 | Juchymenko | F01K 23/065 60/670 |
| 2011/0209473 | A1 | 9/2011 | Fritz et al. | |
| 2013/0186087 | A1 | 7/2013 | Gibble et al. | |
| 2013/0318967 | A1 | 12/2013 | Gaertner et al. | |
| 2014/0208754 | A1 | 7/2014 | Nagai et al. | |
| 2015/0040541 | A1* | 2/2015 | Dane | F01K 23/065 60/274 |

* cited by examiner

METHOD FOR CONTROLLING A WASTE HEAT UTILIZATION SYSTEM FOR AN INTERNAL COMBUSTION ENGINE

The invention relates to a method for controlling a waste heat utilization system for an internal combustion engine of a vehicle, wherein the waste heat utilization system comprises at least one expander which can transmit a torque to the internal combustion engine and which can be bypassed via a bypass flow path, at least one evaporator and at least one pump for an operating medium, in particular ethanol, and wherein at least the evaporator is disposed in the region of the exhaust gas system of the internal combustion engine, wherein the expander which can be operated in several operating modes is drive-connected in at least one operating mode to an auxiliary drive shaft of the internal combustion engine and on the basis of at least one input quantity, in each case one operating mode is selected from at least two operating modes of the waste heat utilization system by a control device and the waste heat utilization system is operated in this operating mode preferably by triggering at least one bypass valve of the expander disposed in a bypass flow path of the expander.

The invention further relates to a waste heat utilization system for a vehicle driven by an internal combustion engine via a drive train, comprising a control device for controlling the waste heat utilization system, wherein the waste heat utilization system comprises at least one expander which can transmit a torque to the internal combustion engine and which can be bypassed via a bypass flow path, at least one evaporator and at least one pump for an operating medium, in particular ethanol, and wherein at least the evaporator is disposed in the region of the exhaust gas system of the internal combustion engine, wherein the expander which can be operated in several operating modes can be drive-connected in at least one operating mode to an auxiliary drive shaft of the internal combustion engine and on the basis of at least one input quantity, in each case one operating mode can be selected from at least two operating modes of the expander and the expander can be operated in this operating mode preferably by triggering at least one bypass valve disposed in the bypass flow path of the expander.

It is known to utilize waste heat of internal combustion engines. Such devices known as WHR (waste heat recovery) systems convert the waste heat of the exhaust gas of the internal combustion engine into mechanical or electrical energy, for example. Such WHR systems are known, for example, from the publications U.S. Pat. No. 8,635,871 A1, U.S. 2011/0209473 A1 or U.S. 2013/0186087 A1.

WO 2006/138459 A2 discloses an organic Rankine cycle which is coupled mechanically and thermally to an internal combustion engine. Here the drive shaft of the internal combustion engine is coupled to a turbine of a waste heat utilization system which extracts waste heat from the inlet air, the coolant, the oil and the exhaust gas of the internal combustion engine. The motor temperature is controlled via bypass valves. For adaptation to different load states, pressure ratios, rotational speeds and temperature of the turbine, various system parameters, in particular the turbine pressure ratio, can be controlled via a control unit by means of bypass valves. An overrunning clutch is provided between the internal combustion engine and the turbine, which enables a rotation of the internal combustion engine without simultaneous driving of the turbine. It is not known from WO 2006/138459 A2 to open the bypass flow path of the turbine in a first operating mode, wherein the turbine is not connected to an auxiliary drive shaft of the internal combustion machine and to close the bypass flow path in a second operating mode, wherein the expander is connected to the internal combustion engine. Furthermore, it is not deduced from this publication that the second operating mode is selected when the pressure or the temperature of the operating medium downstream of the expander exceeds a defined value.

U.S. 2009/0071156 A1 discloses a waste heat recovery device which has a Rankine cycle with a compressor and an expander, wherein the expander can be bypassed via a bypass line. A temperature sensor and a pressure sensor are arranged upstream of the turbine, a pressure sensor is arranged downstream of the turbine. The rotational speed of the expansion device is regulated depending on the information relating to the overheating state of the medium of the Rankine cycle upstream of the expansion device. A mechanical connection of the expansion device to the drive shaft of an internal combustion engine is not provided.

It is the object of the invention to provide a safe and reliable operation of the waste heat utilization system.

According to the invention, this is achieved whereby the input quantity is selected from the group of expander speed, gear information, coasting information, pressure and temperature of the operating medium upstream of the expander and/or pressure and temperature downstream of the expander by the control device, wherein a first operating mode is assigned to a warm-up phase of the expander and a second operating mode is assigned to a normal operating phase of the expander, wherein in the first operating mode the bypass flow path is opened and the expander is not connected to an auxiliary drive shaft of the internal combustion engine and wherein in the second operating mode the bypass flow path is closed and the expander is connected to the internal combustion engine, wherein the second operating mode is selected when the pressure and/or the temperature of the operating medium exceeds a defined value downstream of the expander. Conversely, a change can be made from the second operating mode into the first operating mode when the pressure and/or the temperature of the operating medium downstream and/or upstream of the expander exceeds a defined value.

In the first operating mode the bypass valve is opened, the starting device is deactivated. The operating medium is thus guided past the expander, with the result that the expander does not generate any torque. In the second operating mode, the bypass valve is closed, the starting device is also deactivated. When the bypass valve is closed, the operating medium flows through the expander with the result that this performs work.

It is particularly advantageous if a third operating mode is assigned to at least one gear change phase. During a gear change the waste heat utilization system is operated in this third operating mode depending on the switching direction. The position of the bypass valve depends on the switching process, in particular on the direction of the switching process.

During at least one shift-down process the bypass flow path of the expander remains closed and the auxiliary drive shaft is driven by the expander. During at least one shift-up process the bypass flow path of the expander is opened and/or the expander is separated from the auxiliary drive shaft. The gear information, in particular whether a shift-down or a shift-up process is present, is supplied to the control device by a gear sensor of the transmission.

It is particularly advantageous if the waste heat utilization system is operated in a fourth operating mode during at least one coasting mode of the vehicle, during at least one warm-up mode of the internal combustion engine and/or at least one engine braking mode of the internal combustion engine. It is particularly advantageous if the expander is not separated from the auxiliary drive shaft in the fourth operating mode of the expander. Preferably the expander is only separated from the auxiliary drive shaft when the torque of the expander falls below a defined value.

Coasting mode is understood as a torque-free mode of the vehicle in which the disengageable clutch between internal combustion engine and transmission is opened to reduce the resistance in the drive train.

Whether a coasting mode of the vehicle is present or not is notified to the control device by the transmission or the disengageable clutch by means of coasting information.

The expander is separated from the auxiliary drive shaft by means of the centrifugal clutch (overrunning clutch) when the rotational speed of the auxiliary drive shaft is higher than the rotational speed of the expander. Thus, however a starting of the expander by the internal combustion engine is not possible.

Thus, in particular in designs in which the expander can be connected to the auxiliary drive shaft by means of a centrifugal clutch, a fifth operating mode is provided for starting the expander. For starting the expander the waste heat utilization system is operated in the fifth operating mode which provides that the expander is started by activating a starting device connected to the expander.

In the first operating mode and/or when the waste heat utilization system is inactive, the expander is bypassed—when the bypass valve is opened—via the bypass flow path and/or separated from the auxiliary drive shaft (by the disengageable clutch or the centrifugal clutch).

In order to reliably avoid any damage to the waste heat utilization system, it is provided within the framework of the invention that the bypass flow path of the expander is closed when the operating medium of the waste heat utilization system is in an overheated state. In the case of a disengageable clutch between auxiliary drive shaft and expander, it can additionally be provided that the expander is drive-connected to the auxiliary drive shaft when the operating medium of the waste heat utilization system downstream of the expander is in an overheated state and/or when the expander speed exceeds a defined value and/or the speed of the internal combustion engine exceeds a defined value.

When the operating medium of the waste heat utilization system upstream of the expander is in a non-overheated state or when the internal combustion engine is stopped, the expander can be separated from the auxiliary drive shaft without the risk that a critical speed will be exceeded.

The invention is described in detail hereinafter with reference to the non-restrictive figures. In the figures schematically:

In the embodiments shown, components having the same function are provided with the same reference numbers.

Figure 1:
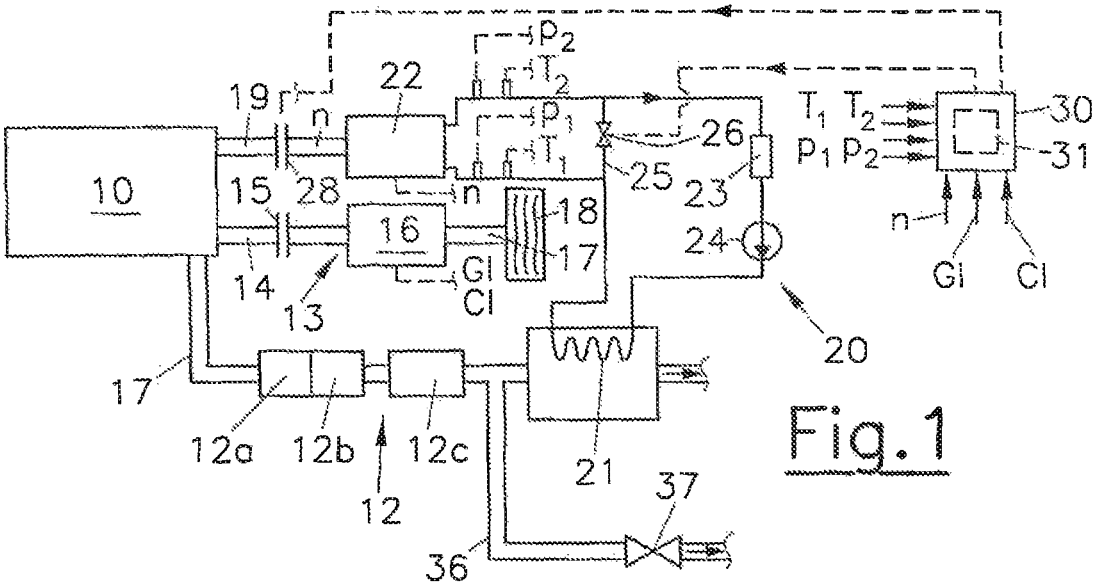
FIG. 1 shows a waste heat utilization system for an internal combustion engine with a control device according to the invention in a first embodiment.
Figure 3:
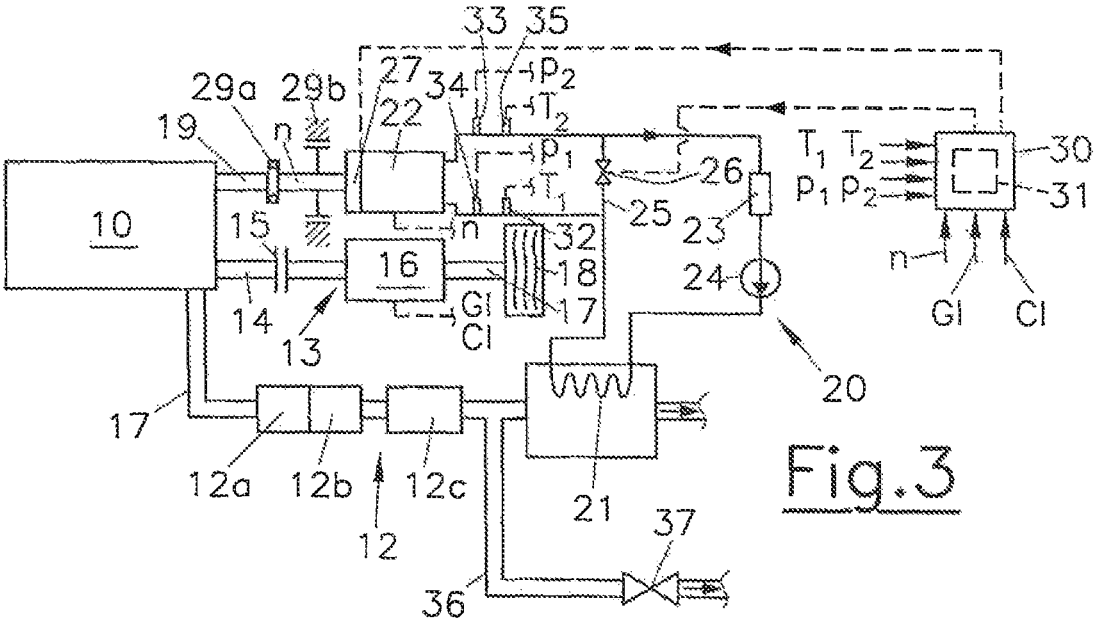
FIG. 3 shows a waste heat utilization system for an internal combustion engine with a control device according to the invention in a second embodiment.

FIG. 1 and FIG. 3 each show an internal combustion engine 10 with an exhaust gas system 11 in which an exhaust gas after-treatment device 12—for example a diesel oxidation catalyst 12, a diesel particle filter 12*b* and an SCR catalyst 12*c* (SCR—selective catalytic reduction)—is arranged. The internal combustion engine 10 has a drive train 13 with a crank shaft 14, a disengageable clutch 15 and a (manual) transmission 16 which acts on the drive shaft 17 of the drive wheels 18.

The internal combustion engine 10 further has a waste heat utilization system 20 for utilizing the exhaust gas values of the exhaust gas system 11 of the internal combustion engine 10. The waste heat utilization system 20 has an evaporator 21 which is arranged downstream of the exhaust gas after-treatment device 12 in the region of the exhaust gas system 11. The waste heat utilization system 20 which functions for example according to the organic Rankine cycle (ORC) comprises, downstream of the evaporator 21 in the operating medium circuit, an expander 22 and a condenser 23, as well as a pump 24 for the operating medium. For example, ethanol can be used as operating medium. In order to bypass the expander 22, a bypass line 25 with a bypass valve 26 is provided. The evaporator 21 can be bypassed on the exhaust gas side via a bypass line 36 and a bypass valve 37 if the exhaust gas heat is too high for the evaporator 21 or the system pressure exceeds a defined value or the cooling system is excessively loaded or the waste heat utilization system 20 is in an error mode or in pure engine mode, without engine braking. The bypass valve 37 is triggered depending on at least one of the operating parameters from the group of fan power, system pressure, system temperature and mass flow of the operating medium.

A control device 30 is provided for controlling the waste heat utilization system 20, which has a program logic 31 which is configured to select the most suitable operating mode from the plurality of operating modes 1 to 4 or 1 to 5 for operation of the waste heat utilization system 20. The selection of the most suitable operating mode is made on the basis of at least one of the input variables of the control device 30, namely: expander rotational speed n, gear information GI, coasting information CI, pressure $p_1$, temperature $T_1$ of the operating medium upstream of the expander 22 as well as the pressure $p_2$ and the temperature $T_2$ of the operating medium upstream of the expander 22. Pressure sensors 32, 33 and temperature sensors 34, 35 are provided upstream and downstream of the expander 22 in the operating medium circuit of the waste heat utilization system 20 to record the parameters pressures $p_1$, $p_2$ and temperatures $T_1$, $T_2$. The pressure sensors 32, 33 and temperature sensors 34, 35 are connected to the control device 30. The gear information GI and coasting information CI are provided, for example by suitable sensors in the transmission 16 of the control device 30.

In the first embodiment shown in FIG. 1, the expander 22 is connected to the auxiliary drive shaft 19 of the internal combustion engine 10 via a disengageable clutch 28. The disengageable clutch 28 is controlled via the control device 30. It enables the expander 22 to start via the internal combustion engine 10 by closing the disengageable clutch 28.

Figure 2:
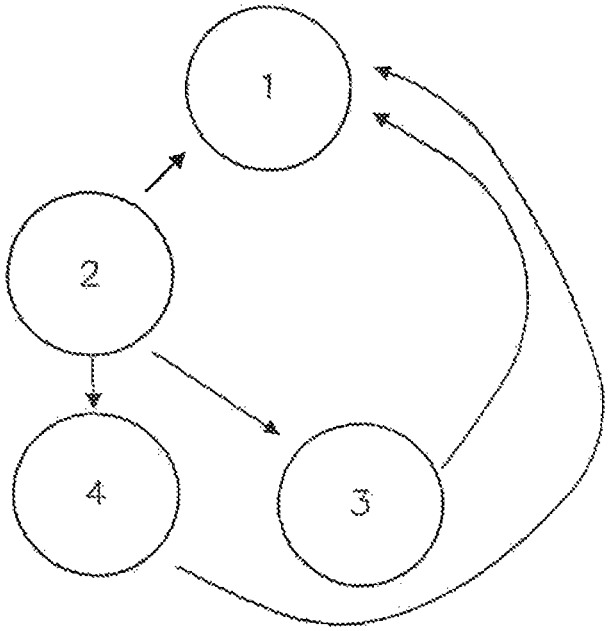
FIG. 2 shows the operating modes of this control device.

The operating modes of this first embodiment are shown in FIG. 2. The following operating modes can be executed with the embodiment shown in FIG. 1:

First operating mode 1 is executed during the warm-up phase of the expander 22; in the operating mode 1 the bypass valve 26 is opened so that the operating medium is guided past the expander 22.

Second operating mode 2: this operating mode 2 is assigned to the normal operation of the expander 22. As soon as the pressure $p_2$ and/or the temperature $T_2$ of the operating medium downstream of the expander 22 exceed a defined value or defined values, the operating mode 2 is activated.

Third operating mode 3: this operating mode 3 is used for gear change processes of the transmission 16.

During the shift-down process the bypass valve 26 is closed. The auxiliary drive shaft 19 is driven by the expander 22 and the torque of the expander 22 is utilized whilst the rotational speed of the crankshaft 14 of the internal combustion engine 10 and the rotational speed of the transmission 16 are synchronized. The disengageable clutch 5 is opened in this case. As a result, the amount of fuel for accelerating the internal combustion engine 10 can be reduced. Furthermore, a certain engine rotational speed can be held during the switching process. Thus, the exhaust gas heat downstream of the exhaust gas after-treatment device 12 can be used to bridge torque drops during shifting pauses.

During the up-shift process the bypass valve 26 of the expander 22 is opened and—in the case of the disengageable clutch 28—the expander 22 is separated from the auxiliary drive shaft 19 by opening the disengageable clutch 28. This avoids the torque being transmitted from the expander 22 to the internal combustion engine 10.

Fourth operating mode 4: this operating mode 4 is used during the coasting mode, the warm-up mode and/or the engine braking mode of the internal combustion engine 10. In the coasting mode the vehicle travels without transmission of torque between internal combustion engine 10 and drive wheels 18, generally with the disengageable clutch 15 open. The bypass valve 26 is closed in the operating mode 4 in order to transmit torque from the expander 22 to the internal combustion engine 10. As a result—in particular when the disengageable clutch 15 is open—the fuel consumption during idling is reduced. When a high torque is provided by the expander 22, the disengageable clutch 15 can be closed until the torque of the expander 22 falls below a defined value.

The second embodiment shown in FIG. 3 differs from FIG. 1 in that instead of the disengageable clutch 28, an overrunning clutch 29*a* and a centrifugal braking device 29*b* are provided for connecting the expander 22 to the auxiliary drive shaft 19 of the internal combustion engine 10.

Figure 4:
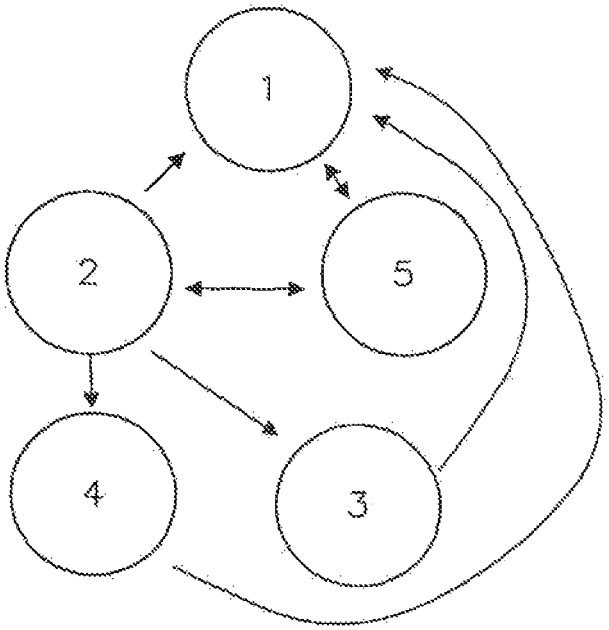
FIG. 4 shows the operating modes of this control device.

For starting the expander 22, in addition to the aforesaid operating modes 1 to 4, the control device 30 can execute a fifth operating mode 5 to start the expander 22 with an internal or external starting device 27 (see FIG. 3, FIG. 4).

In order to avoid the expander 22 being operated at excessive rotational speed and thereby being damaged, the control device 30 provides special safety measures. Thus, the bypass valve 26 is only closed when the operating medium is in an overheated state, i.e. for example when the operating medium ethanol is present in the gas phase. Another safety measure is that the bypass valve 26 is opened when a gear change to a higher gear is implemented. In particular in the embodiment with overrunning clutch 29*a* and centrifugal braking device 29*b* shown in FIG. 3, no further steps are required.

In the embodiment shown in FIG. 1 with a disengageable clutch 28, the bypass valve 26 and the disengageable clutch 28 are only closed when the operating medium is in an overheated state, i.e. for example when the operating medium ethanol is in the gas phase. In the case of a gear change to a higher gear, both the bypass valve 26 and also the disengageable clutch 28 are open.

The disengageable clutch 28 is therefore closed when the operating medium is an overheated state or when the rotational speed n of the expander 22 and/or the rotational speed of the internal combustion engine 10 lies above a defined value. The disengageable clutch 28 is therefore opened when the expander 22 is in a non-overheated state. The disengageable clutch 28 is also opened when the operating state of the internal combustion engine 10 changes from an activated to a deactivated state, that is, when the internal combustion engine 10 is turned off.

The invention claimed is:

1. A method for controlling a waste heat utilization system for an internal combustion engine of a vehicle, the method including the steps of:

providing an internal combustion engine including an exhaust gas system and an auxiliary drive shaft;

providing the waste heat utilization system including at least one expander configured and arranged to transmit a torque to the internal combustion engine and be bypassed via a bypass flow path, at least one evaporator and at least one pump for an operating means, and wherein at least the evaporator is disposed in proximity to the exhaust gas system, operating the at least one expander in at least one operating mode drive-connected to the auxiliary drive shaft on the basis of at least one input signal;

selecting an operating mode from at least two operating modes of the waste heat utilization system by a control device;

operating the waste heat utilization system in the selected operating mode by triggering at least one valve of the at least one expander;

selecting the at least one input signal from the group consisting of: expander speed, gear information, coasting information, pressure and temperature of the operating means upstream of the at least one expander and pressure and temperature downstream of the at least one expander by the control device;

assigning a first operating mode to a warm-up phase of the at least one expander and a second operating mode is assigned to a normal operating phase of the at least one expander, wherein in the first operating mode the bypass flow path is opened and the at least one expander is not connected to the auxiliary drive shaft and wherein in the second operating mode the bypass flow path is closed and the at least one expander is connected to the internal combustion engine; and selecting the second operating mode when the pressure and/or the temperature of the operating means exceeds a defined value downstream of the at least one expander.

2. The method according to claim 1, further including the step of transitioning from the second operating mode into the first operating mode when the pressure and/or the temperature of the operating means upstream of the at least one expander exceeds a defined value.

3. The method according to claim 1, further including the step of operating wherein the waste heat utilization system in a third operating mode during at least one gear change.

4. The method according to claim 3, further including the step of, during at least one shift-down process, closing the bypass flow path of the at least one expander and driving the auxiliary drive shaft via the at least one expander.

5. The method according to claim 3, further including the step of, during at least one shift-up process, opening the bypass flow path of the at least one expander and/or separating the at least one expander from the auxiliary drive shaft.

6. The method according to claim 1, further including the step of operating the waste heat utilization system in a fourth operating mode during at least one coasting mode of the vehicle, during at least one warm-up mode of the internal combustion engine (and/or at least one engine braking mode of the internal combustion engine, and wherein the bypass flow path is closed in the fourth operating mode.

7. The method according to claim 6, wherein in the fourth operating mode the at least one expander is separated from the auxiliary drive shaft when the torque of the at least one expander falls below a defined value.

8. The method according to claim 1, further including the step of operating the waste heat utilization system in a fifth operating mode during at least one starting phase of the at least one expander, and wherein the at least one expander is started by activating a starting device connected to the at least one expander.

9. The method according to claim 1, further including the step of separating the at least one expander from the auxiliary drive shaft in the first operating mode and/or when the waste heat utilization system is inactive.

10. The method according to claim 1, further including the step of closing the bypass flow path when the operating means of the waste heat utilization system is in an overheated state.

11. The method according to claim 1, wherein the at least one expander is drive-connected to the auxiliary drive shaft when the operating means of the waste heat utilization system downstream of the at least one expander is in an overheated state and/or when the expander speed exceeds a defined value and/or a speed of the internal combustion engine exceeds a defined value.

12. The method according to claim 1, wherein the at least one expander is separated from the auxiliary drive shaft when the operating means of the waste heat utilization system upstream of the at least one expander is in a non-overheated state or when the internal combustion engine is stopped.

13. The method according to claim 1, wherein the waste heat utilization system is operated in the selected operating mode by triggering at least one bypass valve of the at least one expander disposed in the bypass flow path.

14. A waste heat utilization system for a vehicle driven by an internal combustion engine via a drive train, the system comprising:

a control device configured and arranged to control the waste heat utilization system;

at least one expander configured and arranged to transmit a torque to the internal combustion engine;

a bypass flow path configured and arranged to bypass the at least one expander;

at least one evaporator; and at least one pump for an operating means, and wherein at least the evaporator is disposed in proximity to the exhaust gas system of the internal combustion engine, wherein the at least one expander is further configured and arranged to be operated in several operating modes, be drive-connected in at least one operating mode to an auxiliary drive shaft of the internal combustion engine and on the basis of at least one input signal, in each case one operating mode can be selected from at least two operating modes of the at least one expander by the control device and the at least one expander can be operated in this operating mode by triggering at least one valve of the at least one expander, wherein the at least one input signal is selected from the group consisting of: expander speed, gear information, coasting information, pressure and temperature of the operating means upstream of the at least one expander and/or pressure and temperature downstream of the at least one expander, wherein a first operating mode is assigned to a warm-up phase of the waste heat utilization system and a second operating mode is assigned to a normal operating phase of the at least one expander, and wherein in at least one operating mode the at least one expander is configured and arranged to be separated from the auxiliary drive shaft, wherein in the first operating mode the bypass flow path is opened and the at least one expander is separated from the auxiliary drive shaft and in the second operating mode the bypass flow path is closed and the at least one expander is connected to the internal combustion engine, and wherein in at least one operating mode the at least one expander is configured and arranged to be separated from the auxiliary drive shaft and wherein the second operating mode is selected when the pressure and/or the temperature of the operating means exceeds a defined value downstream of the at least one expander.

15. The waste heat utilization system according to claim 14, wherein a third operating mode is assigned to at least one gear change phase.

16. The waste heat utilization system according to claim 14, wherein a fourth operating mode is assigned to at least one coasting mode of the motor vehicle, at least one warm-up mode of the internal combustion engine and/or at least one engine braking mode of the internal combustion engine, wherein the fourth operating mode the bypass flow path is closed.

17. The waste heat utilization system according to claim 16, wherein in the fourth operating mode the at least one expander is configured and arranged to be separated from the auxiliary drive shaft.

18. The waste heat utilization system according to claim 14, wherein the at least one expander is configured and arranged to be separated from the auxiliary drive shaft in the first operating mode and/or when the waste heat utilization system is inactive.

19. The waste heat utilization system according to claim 14, wherein the at least one expander is at least connected to a starting device, wherein in a fifth operating mode assigned to at least one starting phase of the at least one expander the at least one expander is configured and arranged to be started by activating the external starting device.

20. The waste heat utilization system according to claim 14, wherein the at least one expander is configured and arranged to be dis/connected to the auxiliary drive shaft via at least one disengageable clutch.

21. The waste heat utilization system according to claim 14, further including at least one overrunning clutch configured and arranged to connect the at least one expander to the auxiliary drive shaft, and at least one centrifugal force braking device disposed between the overrunning clutch and the at least one expander.

22. The waste heat utilization system according to claim 14, wherein at least one expander can be operated in this operating mode by triggering at least one bypass valve of the at least one disposed in the bypass flow path.

* * * * *